US005796805A

United States Patent [19]

Armentrout et al.

[11] Patent Number: 5,796,805

[45] Date of Patent: Aug. 18, 1998

[54] X-RAY SOURCE

[75] Inventors: Charles J. Armentrout, Ann Arbor; Thomas J. Basinger, Ypsilanti, both of Mich.

[73] Assignee: Pilot Industries, Inc., Dexter, Mich.

[21] Appl. No.: 784,836

[22] Filed: Jan. 17, 1997

[51] Int. Cl.[6] ..... H01J 35/00

[52] U.S. Cl. ..... 378/136; 378/119; 378/138

[58] Field of Search ..... 378/119, 121, 378/136, 137, 138, 143, 147, 113

[56] References Cited

U.S. PATENT DOCUMENTS 2,569,872 10/1951 Skehan et al. ..... 378/136

4,368,538 1/1983 McCorkle ..... 378/136 X 5,367,553 11/1994 D'Achard Van Enschut et al. 378/136 X

*Primary Examiner*—David P. Porta

*Attorney, Agent, or Firm*—Gifford, Krass, Groh, Sprinkle, Patmore, Anderson & Citkowski, P.C.

[57] ABSTRACT

An X-ray source is disclosed having an enclosure, typically made of metal or glass. A cathode assembly is contained within the enclosure and the cathode assembly has two through openings along a predefined axis. An anode is also contained within the enclosure at a position spaced from the cathode assembly. The anode, furthermore, has a face normal to the predefined axis so that a portion of the X-rays emitted from the anode pass through the cathode assembly opening and exteriorly of the enclosure.

6 Claims, 1 Drawing Sheet

X-RAY SOURCE

BACKGROUND OF THE INVENTION

I. Field of the Invention

The present invention relates generally to an X-ray source.

II. Description of the Prior Art

There are a number of previously known X-ray sources of the type utilized in industrial inspection applications. Typically, the previously known X-ray source comprises an elongated glass or metallic enclosure having a cathode assembly positioned at one end. An anode is also contained within the enclosure at a position spaced from the cathode assembly and the anode is maintained at a large positive electrical potential, e.g. 50,000 volts. Consequently, electrons emitted from the cathode assembly are attracted to the anode and, upon striking the anode, emit X-ray radiation as well as other radiation.

In the previously known X-ray sources, the face of the anode which faces the cathode assembly is typically tapered at an acute angle with respect to an axis drawn from the cathode assembly to the anode. Consequently, a portion of the X-rays that are emitted from the anode are emitted at the acute angle corresponding to the acute angle of the face of the anode. These electrodes are thus directed outwardly at an acute angle through the sides of the enclosure.

A primary disadvantage of these previously known X-ray sources is that only a very small percentage of the X-rays emitted from the anode emerge out through the sides of the enclosure corresponding to the angle of the anode face. The intensity of x-rays is greatest along a line drawn normal to the anode face and the intensity is zero parallel to the anode face. At the acute anode angle, a small intensity is generated and a small fraction of that is utilized as the production x-ray beam. As such, these previously known X-ray sources are very inefficient in operation. These inefficiencies result in the high power consumption of the X-ray source and heating of the anode. In many situations, the anode must be continuously cooled in order to prevent its destruction.

A still further disadvantage of these previously known X-ray sources is that the anode may become pitted after extended use by the electron beam. The point where the electron beam from the cathode assembly strikes the anode becomes hidden at the bottom of the pitting and this further degrades the efficiency of the X-ray source.

SUMMARY OF THE PRESENT INVENTION

The present invention provides an X-ray source which overcomes all of the above-mentioned disadvantages of the previously known electrodes.

In brief, the X-ray source of the present invention comprises an enclosure, typically constructed of glass or metal. The interior of the closure is evacuated in the conventional fashion.

A cathode assembly is positioned within the enclosure and this cathode assembly has a through opening along a predefined axis. An anode is then positioned within the enclosure at a position spaced from the cathode assembly. This anode, furthermore, includes a face normal to and aligned with the predefined axis so that a relatively high portion of the X-rays that are emitted from the anode are directed back toward the cathode assembly and through cathode assembly opening.

In the preferred embodiment of the invention, the cathode assembly includes an electron source, typically a hot wire, which is positioned to one side of the cathode assembly opening. A pair of arcuate field shaping elements are then positioned on opposite sides of the cathode assembly opening and these field forming elements direct the electrons emitted by the electron source across the cathode assembly opening. As the electrons pass across the cathode assembly opening, the electrons are attracted by the highly positive charged anode.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
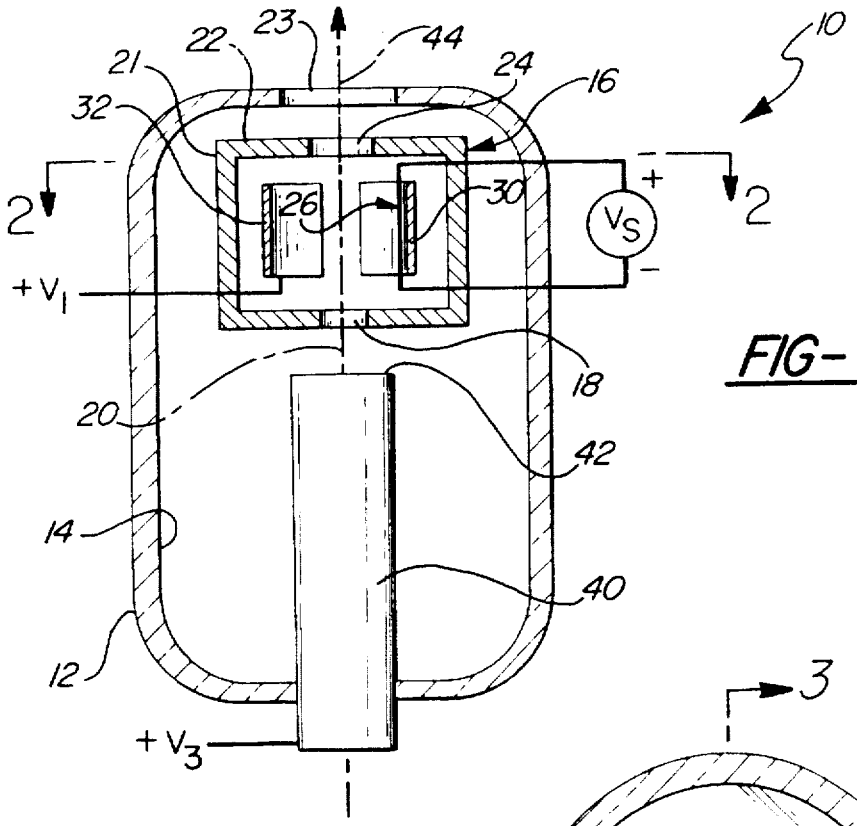
FIG. 1 is a side view illustrating a preferred embodiment of the X-ray source of the present invention.

With reference first to FIG. 1, a preferred embodiment of the X-ray source 10 of the present invention is there shown and comprises an elongated enclosure 12, typically constructed of glass or metal. The enclosure 12 includes an interior 14 which is evacuated so that the interior 14 is maintained at or near a vacuum.

Figure 2:
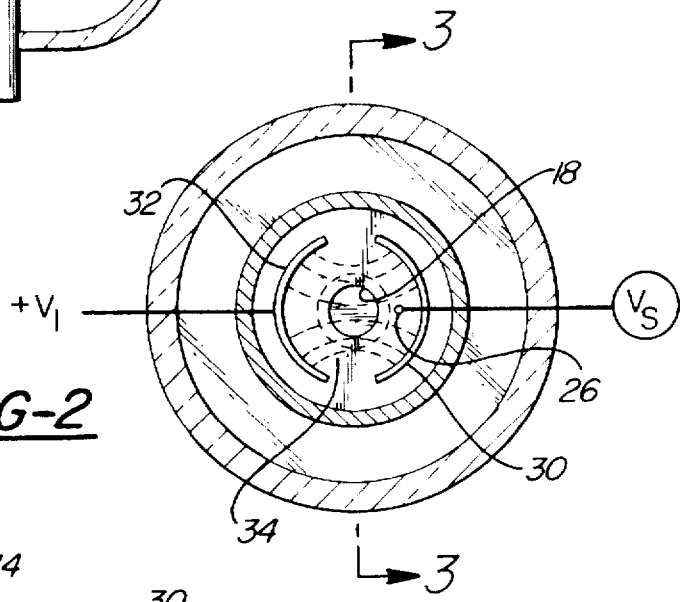
FIG. 2 is a sectional view taken substantially along line 2—2 in FIG. 1.

Referring now to FIGS. 1 and 2, a cathode assembly 16 is contained within the interior 14 of the enclosure 12 adjacent one end. This cathode assembly 16 includes a through opening 18 which is aligned with a predetermined axis 20 for a reason to be shortly described. Additionally, a collimater 22 is optionally associated with the cathode assembly 16 and this collimater 22 also includes a through opening 24 aligned with the axis 20. If the collimater is eliminated, the opening 24 is expanded to include the entire upper surface of the cathode assembly 16.

If the enclosure 12 is made of glass, the cathode assembly 16 may include a metal canister 21. A window 23 is constructed in the conventional fashion for vacuum windows used for X-ray transmission and is mounted to the enclosure 12 and is aligned with the openings 18 and 24.

Figure 3:
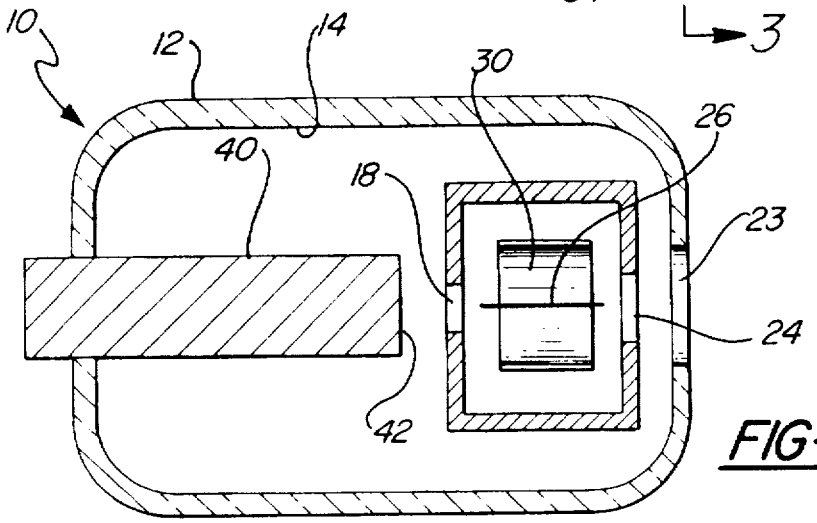
FIG. 3 is a view taken substantially line 3—3 in FIG. 1 and enlarged for clarity.

With reference now to FIGS. 1–3, the cathode assembly 16 further includes an electron source 26 which is a heated wire, such as a tungsten or thoriated tungsten filament heated in the customary way to emit electrons. The electron source 26 is heated by a voltage source $V_S$ which heats the source 26 to a point where the source emits electrons. Furthermore, the electron source 26 is positioned to one side of the opening 18, just in front of one of the field shaping plates 30. Preferably, a portion of the wire 26 extends parallel to an axis 44 (FIG. 1) as best shown in FIG. 2.

As best shown in FIG. 2, a pair of arcuate field shaping elements 30 and 32 are positioned on opposite sides of the opening 18. These field shaping elements 30 and 32 create an arcuate electric field as indicated by the field lines 34 across the opening 18. The field shaping element 32, furthermore, is maintained at a small positive voltage $V_1$ so that electrons emitted by the electron source 26 are attracted by the field shaping element 32 from the electron source 26 and across the opening 18.

With reference again to FIG. 1, the X-ray source includes an anode 40 which has a face 42 normal to and aligned with the predefined axis 20. The anode 40 is maintained at a high positive electrical potential, e.g. 1,000–100,000 volts or more, so that, as the electrons are directed across the opening 18 by the field shaping elements 30 and 32, the electrons are drawn through the opening 18 and towards the anode face 42.

As the electrons impinge against the anode 40, X-rays, as well as other emissions, are emitted from the anode face 42. A relatively high portion of these X-rays are emitted by the anode 40 back toward the cathode assembly 16 along the predefined axis 20. These back emitted x-rays pass not only through the cathode assembly opening 18 but also through the optional collimater opening 22, through the window in the enclosure, and exteriorly of the enclosure 12 as indicated by arrow 44. The X-ray emission is then used in any conventional fashion.

A primary advantage of the X-ray source of the present invention is that, since the X-rays are emitted back through an opening formed through the cathode assembly, the X-ray source of the present invention is much more intense than the previously known X-ray sources in that more x-ray power is in the emitted beam for a given electron current to the anode. Furthermore, since pitting of the anode occurs after prolonged use of the X-ray source, such pitting does not adversely affect the emission of the X-rays along the predefined axis 20 through the cathode assembly.

It will also be seen that the present invention provides a unique cathode assembly which is not only simple and inexpensive in construction, but also highly effective and efficient in operation.

Having described our invention, however, many modifications thereto will become apparent to those skilled in the art to which it pertains without deviation from the spirit of the invention as defined by the scope of the appended claims.

We claim:

1. An x-ray source comprising:

an enclosure, a cathode assembly contained in said enclosure, said cathode assembly having a through opening along a predefined axis, an anode positioned in said enclosure at a position spaced from said cathode assembly, wherein said anode has a face normal to and aligned with said predefined axis so that a portion of X-rays emitted from said anode pass through said cathode assembly opening wherein said cathode assembly further comprises an electron source which generates electrons, said electron source being positioned outside of said cathode assembly opening, means for directing electrons from said electron source across said cathode assembly opening, and wherein said directing means comprises a pair of arcuate electric field shaping elements disposed on opposite sides of said cathode assembly opening, said electron source being positioned adjacent one field shaping element and means for setting the other field shaping element at a positive electrical potential.

2. The invention as defined in claim 1 and comprising at least one collimater aligned with said predefined axis.

3. The invention as defined in claim 1 wherein said electron source comprises a heated wire.

4. The invention as defined in claim 3 wherein said heated wire extends in a direction parallel to said predefined axis.

5. An X-ray source comprising:

an enclosure, a cathode assembly contained in said enclosure, said cathode assembly having a through opening along a predefined axis, an anode positioned in said enclosure at a position spaced from said cathode assembly, wherein said anode has a face normal to and aligned with said predefined axis so that a portion of X-rays emitted from said anode pass through said cathode assembly opening wherein said cathode assembly further comprises an electron source which generates electrons, said electron source being positioned outside of said cathode assembly opening, means for directing electrons from said electron source across said cathode assembly opening wherein said electron source comprises a heated wire which extends in a direction parallel to said predefined axis.

6. The invention as defined in claim 5 and comprising at least one collimater aligned with said predefined axis.

* * * * *